US006755693B2

(12) United States Patent
Nishio et al.

(10) Patent No.: US 6,755,693 B2
(45) Date of Patent: Jun. 29, 2004

(54) CONNECTOR WITH A CONTACT FIXED TO ITS HOUSING PART

(75) Inventors: Atsushi Nishio, Mito (JP); Katsuhiro Hori, Mito (JP); Fumihiro Hosoya, Mito (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 32 days.

(21) Appl. No.: 10/106,308

(22) Filed: Mar. 26, 2002

(65) Prior Publication Data

US 2002/0142665 A1 Oct. 3, 2002

(30) Foreign Application Priority Data

Mar. 29, 2001 (JP) ..... 2001-097100

(51) Int. Cl.[7] ..... H01R 24/00
(52) U.S. Cl. ..... 439/660; 439/733.1
(58) Field of Search ..... 439/660, 733.1, 439/701

(56) References Cited

U.S. PATENT DOCUMENTS 3,757,277 A * 9/1973 Yamanoue et al. ..... 439/660
5,782,650 A * 7/1998 Okabe ..... 439/399
5,879,196 A * 3/1999 Lee ..... 439/660
5,980,328 A * 11/1999 Takanashi et al. ..... 439/733.1
6,106,338 A * 8/2000 Wu et al. ..... 439/660

* cited by examiner

*Primary Examiner*—Tho D. Ta
(74) *Attorney, Agent, or Firm*—Ladas & Parry

(57) ABSTRACT

A connector includes a contact having an end part connected to another connection device and another end part connected to a cable, and a housing part fixed to the contact by pushing the contact with pressure, wherein the housing part has a first housing part and a second housing part mounted to the first housing part and having a float stop part, the other end part of the contact extends from the first housing part in a state where the contact is fixed to the housing part, and the other end part of the contact is received with the float stop part of the second housing part whereby the contact is prevented from floating.

3 Claims, 8 Drawing Sheets

CONNECTOR WITH A CONTACT FIXED TO ITS HOUSING PART

BACKGROUND OF THE INVENTION

1. Field of the Invention

The present invention relates to connectors and more particularly, to a connector having a structure in which a contact is fixed to a housing part.

2. Description of the Related Art

Recently, a personal computer uses a USB (Universal Serial Bus) interface in order to unify an interface between the personal computer and peripheral devices. A USB cable is used for connecting the personal computer having the USB interface to the peripheral device. The USB cable has one end part to which a series A connector connected to the personal computer is provided. The USB cable has another end part to which a series B connector connected to the peripheral device is provided.

FIG. 1 is a expanded sectional view of a related art series mini B connector. Referring to FIG. 1, a housing part is formed by resin molding. The housing 1 has a structure in which a body part 3, an expand part 4, and a float stop part 8 are formed in a body. A contact 2 has a structure in which a connection part 5, a cable connection part 6, and a fixed part 9 are formed in a body.

In the related art, the contact 2 is provided in the housing part 1 by insert forming. The contact 2 is insert formed in the housing 1, so that the fixed part 9 of the contact 2 is fixed to the body part 3.

The connection part 5 of the contact 2 has a back surface butting the expand part 4. The connection part 5 of the contact 2 also has another surface that is exposed and connected to a contact of a connector of the peripheral device. The cable connection part 6 of the contact 2 extends in a right direction in FIG. 1 from the body part 3. The USB cable not shown in FIG. 1 is electrically connected to the cable connection part 6.

In a state where an end part 7 of the cable connection part 6 is free, the cable connection part 6 floats so that a connection to the cable is deteriorated. In order to prevent the cable connection part 6 from floating, the housing part 1 has the float stop part 8. In addition, the end part 7 of the contact 2 is embedded in the float stop part 8 when the contact 2 is insert formed in the housing 1. As a result, the cable connection part 6 can be prevented from floating. Therefore, the connection to the cable improves and a position switch (change of position) of the contact 2 can be prevented from occurring.

However, according to the related art connector, the contact 2 is provided in the housing 1 by insert forming. Accordingly, the resin may leak out to the connection part of the contact 2. As a result, the reliability of the connection of the contact may be deteriorated.

In the insert forming process, the housing part 1 is formed in a state where the contact 2 is mounted in a mold. Since the connection part 5, as described above, is exposed after being formed, a mold process is implemented in a state where the connection part 5 comes in contact with the mold directly.

However, it is difficult to adhere the connection part 5 of the contact 2 to a surface of the mold with no space between the connection part 5 and the mold. Furthermore, since heat is applied in the molding process, a space between the connection part 5 and the mold may be provided due to the thermal expansion. As a result, the resin may leak out to the connection part 5 of the contact 2 when the contact 2 is insert formed in the housing 1.

In addition, a structure of the mold for insert molding is more complicated than one for general resin molding. Furthermore, an apparatus for mounting the contact 2 in the mold and others are necessary and thereby a cost for providing facilities may be increased.

SUMMARY OF THE INVENTION

Accordingly, it is a general object of the present invention to provide a novel and useful connector in which one or more of the problems described above are eliminated.

Another and more specific object of the present invention is to provide a connector by which the reliability of the connection of the contact can improve and the cost for providing facilities can be decreased.

The above objects of the present invention are achieved by a connector including a contact having an end part connected to another connection device and another end part connected to a cable, and a housing part fixed to the contact by pushing the contact with pressure, wherein the housing part has a first housing part and a second housing part mounted to the first housing part and having a float stop part, the other end part of the contact extends from the first housing part in a state where the contact is fixed to the housing part, and the other end part of the contact is received with the float stop part of the second housing part whereby the contact is prevented from floating.

According to the present invention described above, the contact is pushed in the housing part by pressure. Therefore, a forming process of the housing part is separated from a mounting process of the contact in the housing. Accordingly, the resin does not leak out to the contact in the present invention because the contact is not arranged by the insert forming in the related art. Hence, it is possible to improve the reliability of the connection of the contact.

Furthermore, although the contact is fixed to the housing by pushing the contact with pressure, in the present invention, the end part of the contacts is prevented from floating by the float stop part. Accordingly, it is possible to hold the contact at the designated position accurately, so that it is possible to connect the cable connected to the connector and the contact accurately.

In addition, the housing part includes the first housing part and the second housing part. Therefore, it is possible to simplify the structures of the first housing part and the second housing part, and thereby the mold can be simplified. Furthermore, a device for mounting the contact to the mold, which is necessary for an insert forming process, is not necessary in this embodiment. Accordingly, it is possible to decrease the cost for providing facilities.

Other objects, features, and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of embodiments of the present invention.

Figure 1:
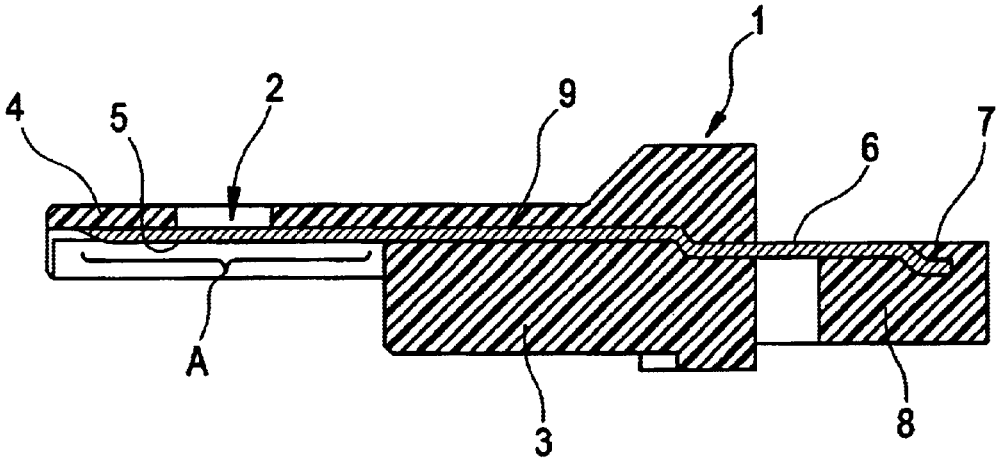
FIG. 1 RELATED ART
FIG. 1 is an expanded sectional view of a related art series mini B connector.
Figure 2A:
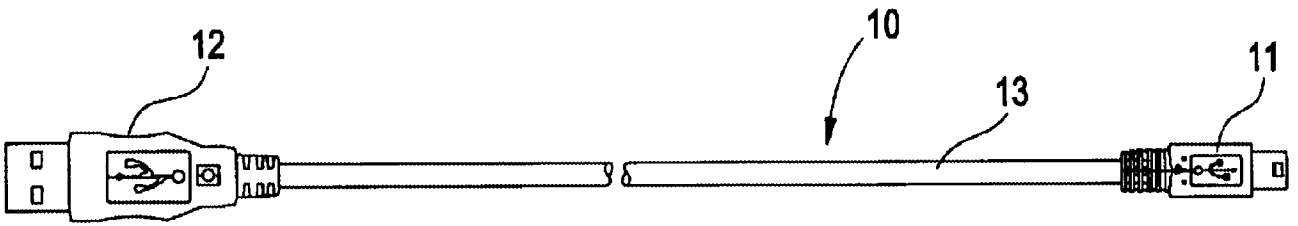
FIG. 2-(A) is a plan view of a USB cable to which a connector of an embodiment of the present invention is connected, FIG. 2-(B) is an elevational view of the USB cable to which the connector of an embodiment of the present invention is connected, and FIG. 2-(C) is a bottom view of the USB cable to which the connector of an embodiment of the present invention is connected.
Figure 2B:
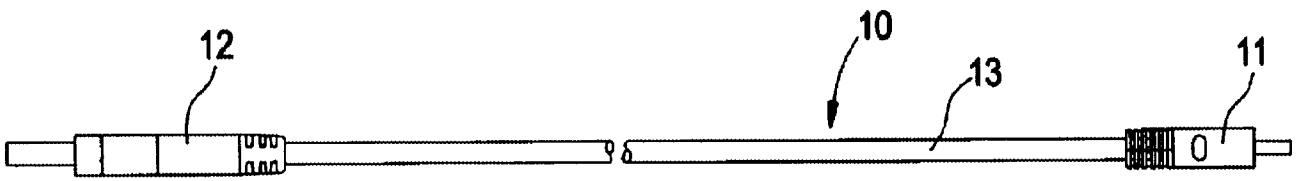
Figure 2C:
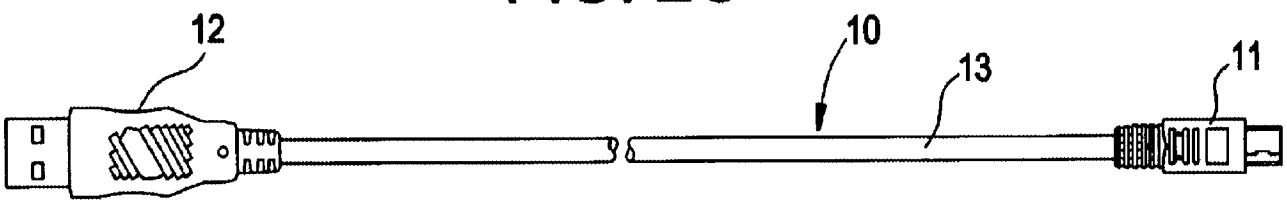
Figure 3A:
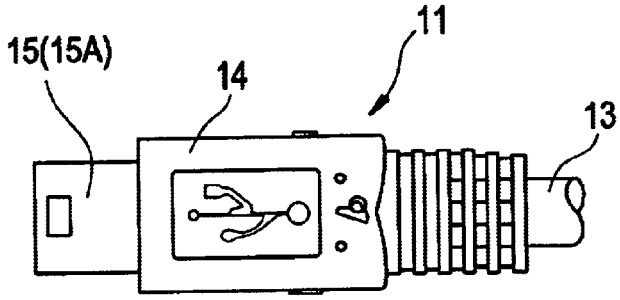
FIG. 3-(A) is a plan view showing an outside appearance of the connector of the embodiment according to the present invention, FIG. 3-(B) is an elevational view showing the outside appearance of the connector of the embodiment according to the present invention, FIG. 3-(C) is a bottom view showing the outside appearance of the connector of the embodiment according to the present invention, and FIG. 3-(D) is a left side view showing the outside appearance of the connector of the embodiment according to the present invention.
Figure 3D:
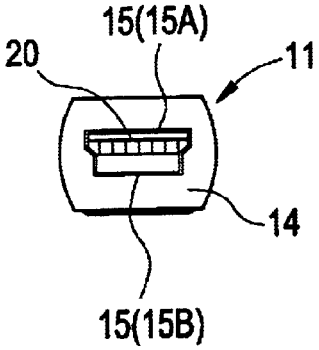
Figure 3B:
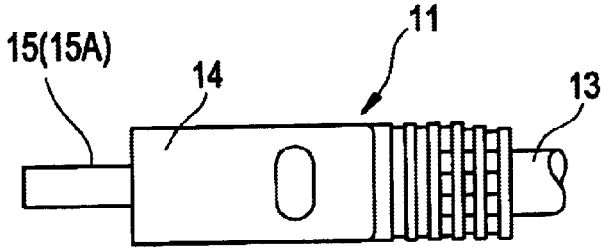
Figure 3C:
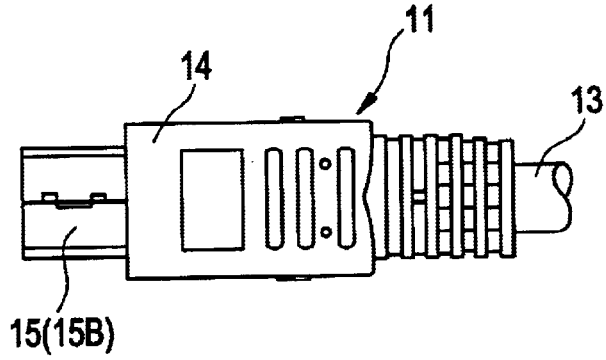

FIG. 2-(A) is a plan view of a USB cable to which a connector of an embodiment of the present invention is connected, FIG. 2-(B) is an elevational view of the USB cable to which the connector of the embodiment of the present invention is connected, and FIG. 2-(C) is a bottom view of the USB cable to which the connector of the embodiment of the present invention is connected. Referring to FIG. 2, a USB cable 10 includes a series B connector 11, a series A connector 12, and a cable 13. The series B connector 11 is connected to a peripheral device. The series A connector 12 is connected to a personal computer. The cable 13 is connected to the series B connector 11 and the series A connector 12. The present invention is applied to the series B connector (hereinafter "connector") 11.

Figure 4:
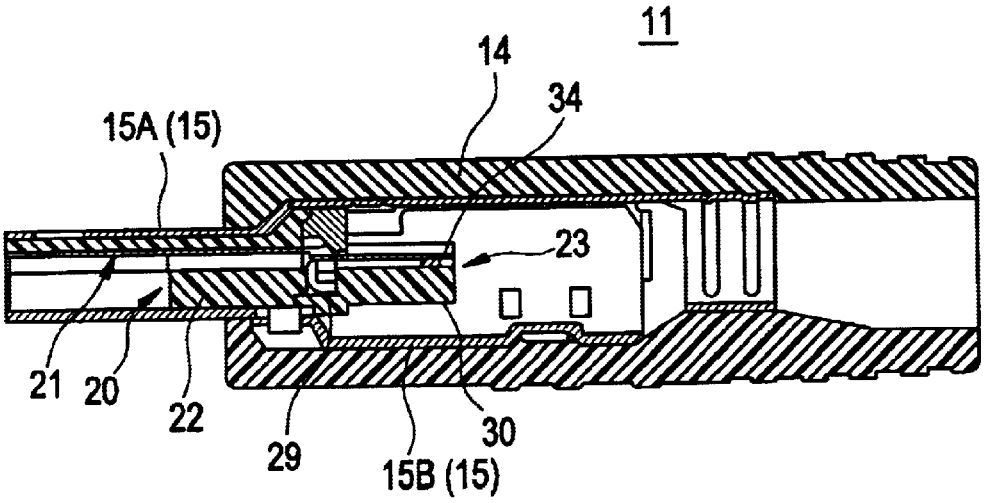
FIG. 4 is a cross sectional view of the connector of the embodiment according to the present invention.

FIG. 3-(A) is a plan view showing an outside appearance of the connector of the embodiment according to the present invention, FIG. 3-(B) is an elevational view showing the outside appearance of the connector of the embodiment according to the present invention, FIG. 3-(C) is a bottom view showing the outside appearance of the connector of the embodiment according to the present invention, and FIG. 3-(D) is a left side view showing the outside appearance of the connector of the embodiment according to the present invention. FIG. 4 is a cross sectional view of the connector of the embodiment according to the present invention.

Referring to FIGS. 3 and 4, the connector 11 includes a mold part 14, a shield case 15, a housing part 20, a contact 21 and others. The mold part 14 is formed by resin molding. The shield case 15, the housing 20 and the contact 21 are provided inside of the mold part 14. The housing part 20 and the contact 21 are shielded by the shield case 15. The shield case 15 has a structure in which a first shield case part 15A is arranged at an upper part of the case 15 and a second shield case part 15B is arranged at a lower part of the case 15.

The shield case 15 is connected to a shield line arranged in the cable 13. Hence, an electrical disturbance can be prevented from invading to the contact 21 by the shield case 15.

The contact 21 is fixed in the shield case 15 and the mold part 14 by the housing part 20.

Figure 5:
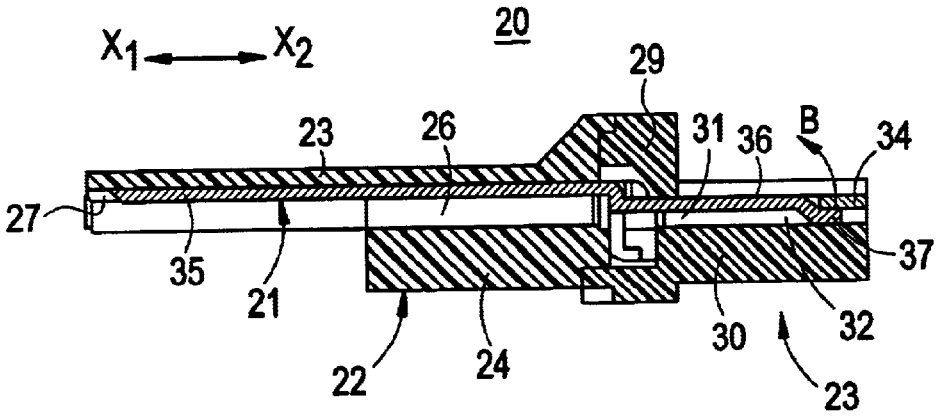
FIG. 5 is an expanded sectional view of a connector of the embodiment of the present invention.
Figure 6:
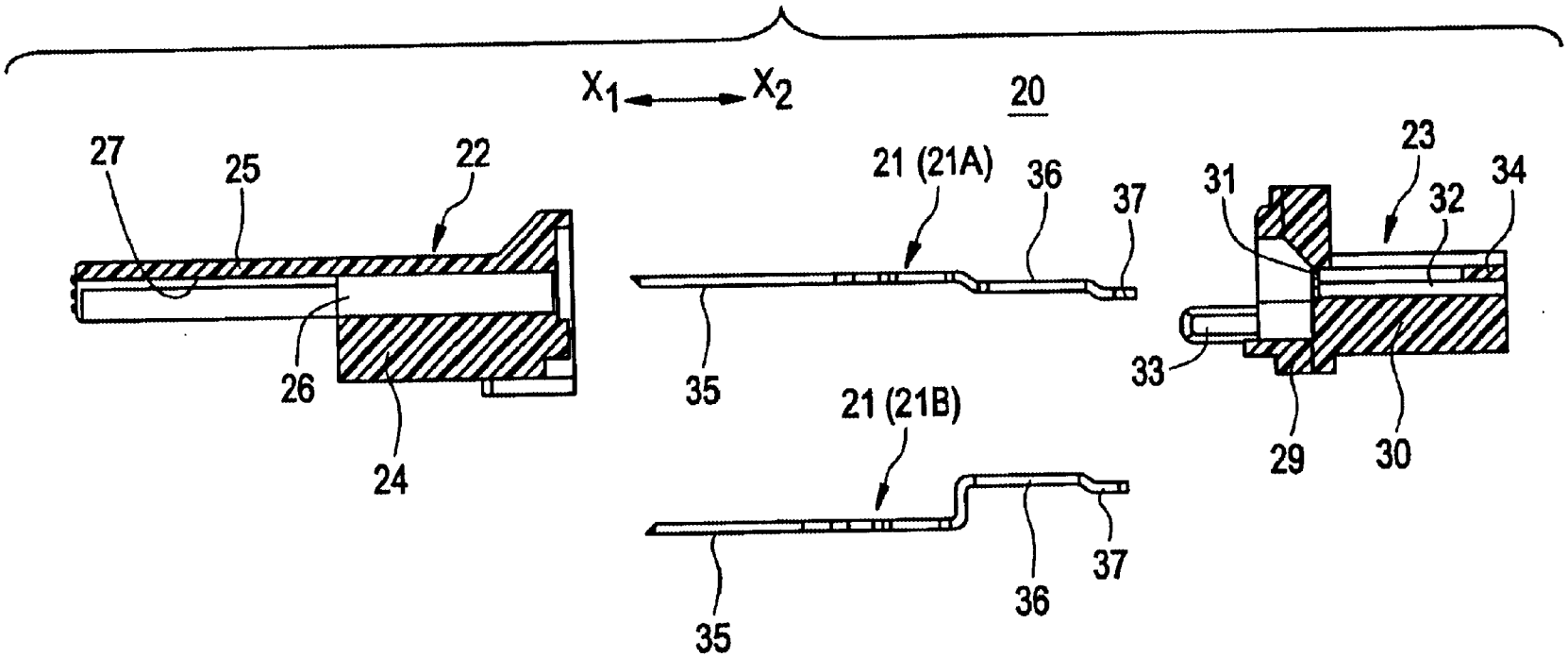
FIG. 6 is a cross sectional view showing a state where the connector of the embodiment of the present invention is expanded.
Figure 7D:
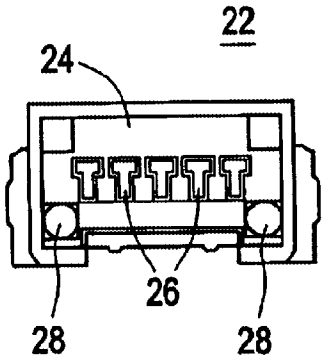
FIG. 7-(A) is an expanded elevational view of a first housing part of the connector of the embodiment according to the present invention, FIG. 7-(B) is an expanded bottom view of the first housing part of the connector of the embodiment according to the present invention, FIG. 7-(C) is a left side view of the first housing part of the connector of the embodiment according to the present invention, and FIG. 7-(D) is a right side view of the first housing part of the connector of the embodiment according to the present invention.
Figure 7A:
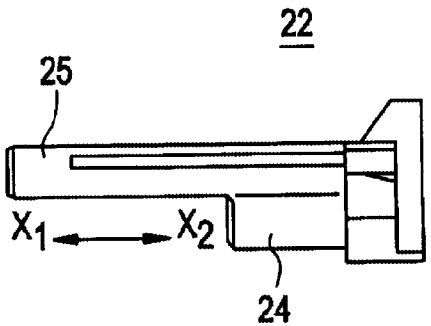
Figure 7B:
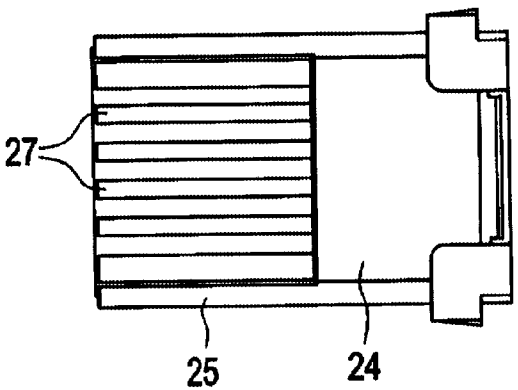
Figure 7C:
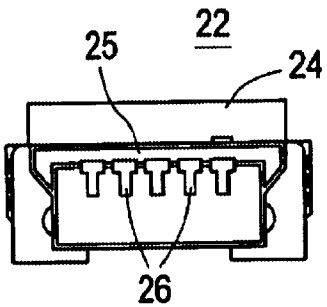
Figure 8A:
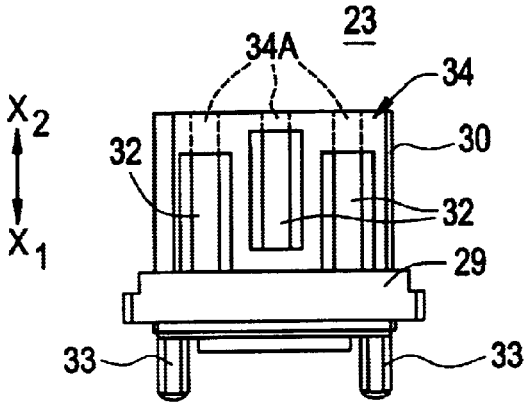
FIG. 8-(A) is an expanded plan view of a second housing part of the connector of the embodiment according to the present invention, FIG. 8-(B) is an expanded elevational view of the second housing part of the connector of the embodiment according to the present invention, FIG. 8-(C) is an expanded bottom view of the second housing part of the connector of the embodiment according to the present invention, FIG. 8-(D) is an expanded rear elevation of the second housing part of the connector of the embodiment according to the present invention, and FIG. 8-(E) is an expanded right side view of the second housing part of the connector of the embodiment according to the present invention.
Figure 8B:
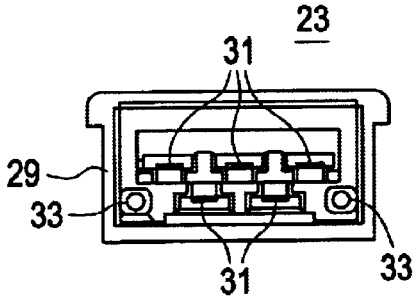
Figure 8E:
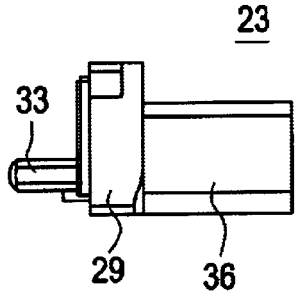
Figure 8C:
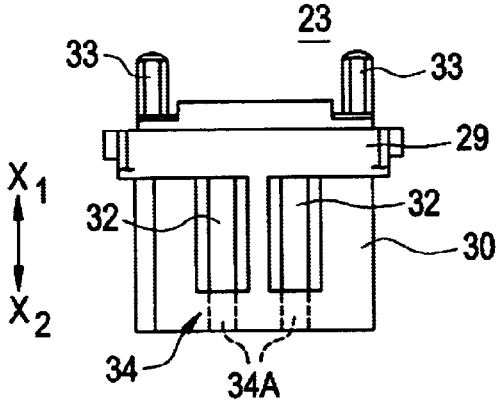
Figure 8D:
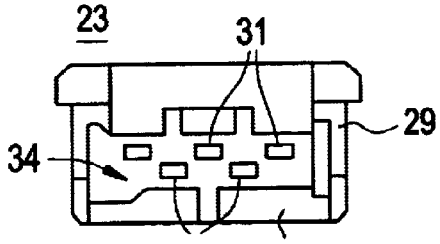

FIG. 5 is an expanded sectional view of a connector of the embodiment of the present invention. FIG. 6 is a cross sectional view showing a state where the connector of the embodiment of the present invention is expanded. Referring to FIGS. 5 and 6, the housing part 20 includes a first housing part 22 and a second housing part 23. Both the first housing part 22 and the second housing part 23 are formed by resin molding.

FIG. 7-(A) is an expanded elevational view of the first housing part of the connector of the embodiment according to the present invention, FIG. 7-(B) is an expanded bottom view of the first housing part of the connector of the embodiment according to the present invention, FIG. 7-(C) is a left side view of the first housing part of the connector of the embodiment according to the present invention, and FIG. 7-(D) is a right side view of the first housing part of the connector of the embodiment according to the present invention. Referring to FIG. 7, the first housing part 22 has a structure in which a first housing body part 24 and a first extension part 25 are formed in a body. A first contact insertion hole 26 is situated in the housing body part 24. The contact 21 is mounted in the first contact insertion hole 26. As shown in FIG. 7-(D), receiving holes 28 are situated in the first housing body part 24. Projection parts 33 formed in the second housing part 23 are inserted in the receiving holes 28 so that the first housing body part 24 is connected to the second housing part 23.

The first extension part 25 is extend formed in an arrow X1 direction in FIG. 7-(A) from the first housing body part 24. As shown in FIG. 7-(B), a first contact mount groove 27 is formed at a bottom surface side of the first extension part 25.

When the contact 21 is mounted to the first housing part 22, a connection part 35 of the contact 21 comes in contact with the first contact mount groove 27 so that a position switch (change of position) of the contact 21 can be prevented from occurring. The connection part 35 of the contact 21 is electrically connected to the connector provided in the peripheral device. Accordingly, it is possible to improve the reliability of a connection between the contact 21 and the connector provided in the peripheral device by positioning the connection part 35 with the first contact mount groove 27.

FIG. 8-(A) is an expanded plan view of a second housing part of the connector of the embodiment according to the present invention, FIG. 8-(B) is an expanded elevational view of the second housing part of the connector of the embodiment according to the present invention, FIG. 8-(C) is an expanded bottom view of the second housing part of the connector of the embodiment according to the present invention, FIG. 8-(D) is an expanded rear elevation of the second housing part of the connector of the embodiment according to the present invention, and FIG. 8-(E) is an expanded right side view of the second housing part of the connector of the embodiment according to the present invention. Referring to FIG. 8, the second housing part 23 has a structure in which a second housing body part 29 and a second extension part 30 are formed in a body. A second contact insertion hole 31 is situated in the second housing body part 29. The contact 21 is mounted in the second contact insertion hole 31. The projection parts 33 formed in the second housing body part 29 are inserted in the receiving holes 28 of the first housing part 22 so that the first housing body part 24 is connected to the second housing part 23.

The second extension part 30 is extend formed in an arrow X2 direction in FIG. 8-(A) from the second housing body part 29. Second contact mount grooves 32 are formed at an upper surface side and a bottom surface side of the second extension part 30. The second contact mount grooves 32 formed at the upper surface side of the second extension part 30 are shown in FIG. 8-(A). The second contact mount grooves 32 formed at the bottom surface side of the second extension part 30 are shown in FIG. 8-(C).

When the contact 21 is mounted to the second housing part 23, a connection part 36 of the contact 21 comes in contact with the first contact mount groove 27 so that a position switch (change of position) of the contact 21 can be prevented from occurring.

The connection part 36 of the contact 21 is electrically connected to an electrical wire provided in the cable 13. Accordingly, it is possible to connect the cable 13 and the contact 21 accurately by positioning the connection part 36 with the second contact mount groove 32.

In addition, a float stop part 34 is formed in the second housing part 23.

Figure 9A:
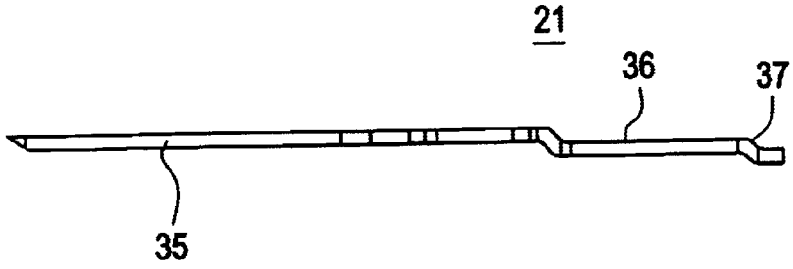
FIG. 9-(A) is an expanded elavational view of a contact forming the connector of the embodiment according to the present invention, and FIG. 9-(B) is an expanded plan view showing the contacts forming the connector of the embodiment according to the present invention in a state where the contacts are cut for making the each contact.
Figure 9B:
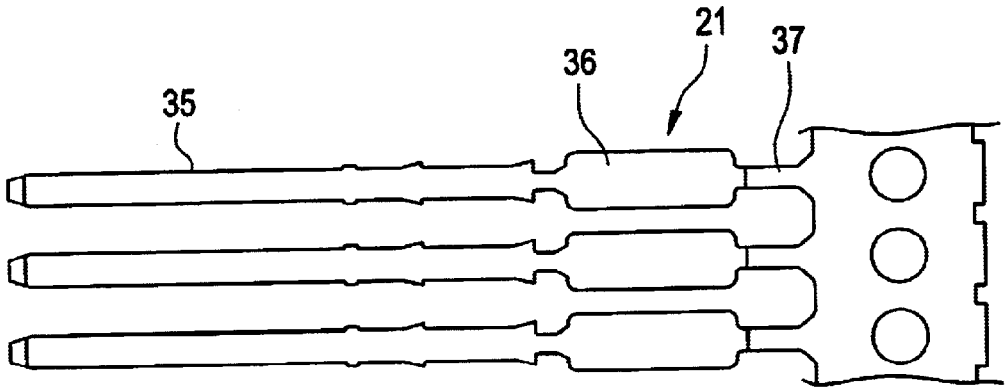

FIG. 9-(A) is an expanded elavational view of a contact forming the connector of the embodiment according to the present invention, and FIG. 9-(B) is an expanded plan view showing the contacts forming the connector of the embodiment according to the present invention in a state where the contacts are cut for making the each contact. Referring to FIG. 9, the contact 21 is formed by a press process of a copper alloy board. The contact 21 has a structure in which the connection part 35, the cable connection part 36 and an end part 37 are formed in a body. In addition, the contact 21 has a surface where gold plating is implemented.

As described above, the connection part 35 is electrically connected to the connector of the peripheral device. The cable connection part 36 is connected to the cable 13. The end part 37 is received with the float stop part 34 formed in the second housing part 23.

The contact 21 includes a contact 21A and a contact 21B. The cable connection part 36 of the contact 21A is exposed to an upper surface side of the second extension part 30. The cable connection part 36 of the contact 21B is exposed to a bottom surface side of the second extension part 30. In the following description, the contact 21A and the contact 21B are called the contact 21 as long as the contact 21A and the contact 21B are distinguished from each other.

Referring to FIGS. 5 and 6, an assembly method of the housing 20 having the above described structure will be described.

In order to assemble the housing 20, first, the contact 21 is mounted to the first housing part 22. In this case, the contact 21 is pushed to the first housing part 22 by a pressure.

More specifically, the connection part 35 of the contact 21 is positioned to the first contact insertion hole 26 formed in the first housing part 22. The connection part 35 inserts in an arrow X1 direction in FIGS. 5 and 6 to a designated position where the connection part 35 is received with the first contact mount groove 27. In a state where the contact 21 is mounted to a designated position of the first housing part 22, the cable connection part 36 and the end part 37 of the contact 21 are extended in the arrow X2 direction in FIGS. 5 and 6 from the first housing part 22.

As described above, after the contact 21 is mounted to the first housing part 22, the second housing part 23 is mounted to the first housing part 22. More specifically, the projection parts 33 formed in the second housing part 23 are positioned and inserted in the receiving holes 28 formed in the first housing part 22, the projection parts 33 are received by the receiving holes 28. As a result, the first housing part 22 is connected to the second housing part 23 in a body.

In this case, the end part 37 and the cable connection part 36 extending in the arrow X2 direction from the first housing part 22 are pushed to the second contact insertion hole 31 of the second housing part 23 by pressure. In a state where the second housing part 23 is mounted to the first housing part 22, the cable connection part 36 is received with the second contact mount groove 32 and the end part 37 is received with the float stop part 34.

Next, the float stop part 34 will be described. The float stop part 34 is formed at an end part in the arrow X2 direction of the second housing part 23, so that the float stop part 34 is received with the end part 37 of the contact 21. More specifically, as shown in FIGS. 8-(A) and 8-(C), the second contact mount groove 32 is not formed to an end part in the arrow X2 direction of the second extension part 30 completely. A float stop hole 34A is formed at a forming position of the float stop part 34.

The end part 37 of the contact 21 is inserted in the float stop hole 34A based on a mounting of the second housing part 23 to the first housing part 22, so that the end part 37 is received with the float stop part 34 (float stop hole 34A). Hence, the contact 21 is prevented from floating in an arrow B direction shown in FIG. 5.

As described above, in this embodiment, the contact 21 is pushed in the housing 20 (the first housing part 22 and the second housing part 23) by pressure, so that the contact 21 is fixed to the housing 20. Accordingly, a forming process of the first housing part 22 and the second housing part 23 is separated from a mounting process of the contact 21 in the housing 20.

Accordingly, the resin does not leak out to the contact 21 in the present invention because the contact 21 is not arranged by the insert forming as in the related art as shown in FIG. 9. Hence, it is possible to electrically connect the connector 11 to the peripheral device accurately. Accordingly, it is possible to improve the reliability of the connection of the contact 11. Furthermore, although it is necessary to implement a process for eliminating the resin leaking out to the connection part 5 in the related art, it is not necessary to implement a process for eliminating the resin leaking out according to the connector 11 of this embodiment.

When the contact 21 is pushed to the housing 20 by pressure, the fixed strength is reduced as compared with a structure where the contact 2 is fixed to the housing 1 by insert forming, so that the contact 21 may float. The float occurs when the connection part 35 is pushed with a pressure by mounting the connector 11 to the connector of the peripheral device. The float occurs at the end part 37 situated at an opposite side to a forming position of the connection part 35 of the contact 21.

However, as described above, in this embodiment, the end part 37 of the contact 21 is prevented from floating by the float stop part 34. Accordingly, it is possible to hold the contact 21 in the housing 20 accurately, so that it is possible to connect the cable 13 and the contact 21 (cable connection part 36) accurately.

Furthermore, in this embodiment, the housing part 20 comprises the first housing part 22 and the second housing part 23. Therefore, it is possible to simplify the structures of the first housing part 22 and the second housing part 23, and thereby the mold can be simplified. In addition, a device for mounting the contact to the mold, which is necessary for insert forming process, is not necessary in this embodiment. Accordingly, it is possible to decrease the cost for providing facilities.

The present invention is not limited to these embodiments, but variations and modifications may be made without departing from the scope of the present invention. For example, although an example wherein the present invention is applied to the connector 11 used in the USB cable 10 is described above, the present invention is not limited to this embodiment. The present invention can be applied to a connector having a structure in which a contact is fixed to the housing, for example.

This patent application is based on Japanese priority patent application No. 2001-097100 filed on Mar. 29, 2001, the entire contents of which are hereby incorporated by reference.

What is claimed is:

1. A connecter comprising:

a contact having a first end part connected to a connection device and a second end part connected to a cable; and a housing part fixed to the contact by pushing the contact with pressure, wherein the housing part has a first housing part and a second housing part mounted to the first housing part and having a float stop part, and wherein the first housing part has a first contact insertion hole to which the contact can be inserted, and the second housing part has a second contact insertion hole to which the contact can be inserted, and further wherein the contact is mounted to the first contact insertion hole and pushed to the second contact insertion hole by the pressure whereby the contact is fixed to the housing part; and the second end part of the contact extends from the first housing part in a state where the contact is fixed to the housing part, and the second end part of the contact is received with the float stop part of the second housing part whereby the contact is prevented from floating.

2. A connecter comprising:

a contact having a first end part connected to a connection device and a second end part connected to a cable; and a housing part fixed to the contact by pushing the contact with pressure, wherein the housing part has a first housing part and a second housing part mounted to the first housing part and having a float stop part, the float stop part of the second housing part having a float stop hole, wherein the second end part of the contact extends from the first housing part in a state where the contact is fixed to the housing part, and wherein the second end part of the contact is received with the float stop part of the second housing part whereby the contact is prevented from floating.

3. A connecter comprising:

a contact having a first end part connected to a connection device and a second end part connected to a cable; and a housing part fixed to the contact by pushing the contact with pressure, wherein the housing part has a first housing part and a second housing part mounted to the first housing part and having a float stop part, wherein the second end part of the contact extends from the first housing part in a state where the contact is fixed to the housing part, wherein the second end part of the contact is received with the float stop part of the second housing part whereby the contact is prevented from floating wherein the first housing part has a first contact insertion hole to which the contact can be inserted, wherein the second housing part has a second contact insertion hole to which the contact can be inserted, wherein the contact is mounted to the first contact insertion hole and pushed to the second contact insertion hole by the pressure whereby the contact is fixed to the housing part, and wherein the float stop part of the second housing part has a float stop hole.

* * * * *